US005711220A

United States Patent [19]

Calbrix et al.

[11] Patent Number: 5,711,220

[45] Date of Patent: Jan. 27, 1998

[54] SLIDABLE STOP ON A PRODUCT-GUIDING CYLINDER ASSOCIATED WITH A ROTARY PRINTING PRESS

[75] Inventors: Jean-Claude Calbrix, Rantigny; Philippe Herda, Longueil Sainte Marie; Thierry Vauchelle, Saint Just En Chaussée, all of France

[73] Assignees: Heidelberger Druckmaschinen AG, Heidelberg, Germany; Heidelberg Harris SA, Montataire Cedex, France

[21] Appl. No.: 798,512

[22] Filed: Feb. 10, 1997

[30] Foreign Application Priority Data

Feb. 9, 1996 [FR] France ..... 96 01614

[51] Int. Cl.[6] ..... B41F 21/00; B41F 1/30

[52] U.S. Cl. ..... 101/246; 101/409; 101/415.1; 271/3.24; 271/277

[58] Field of Search ..... 101/246, 409, 101/410, 415.1, 411; 271/3.24, 277

[56] References Cited

U.S. PATENT DOCUMENTS

| | | | |
|---|---|---|---|
| 2,865,289 | 12/1958 | Fowlie et al. | 101/409 |
| 4,372,209 | 2/1983 | Jentzsch et al. | 101/409 |
| 4,718,342 | 1/1988 | Raab et al. | 101/409 |
| 4,824,096 | 4/1989 | Fichter et al. | 271/277 |
| 4,831,353 | 5/1989 | Raab et al. | 101/410 |
| 4,864,929 | 9/1989 | Simeth | 101/246 |
| 5,184,554 | 2/1993 | Merkel et al. | 101/409 |
| 5,553,543 | 9/1996 | Takahashi et al. | 101/409 |
| 5,605,098 | 2/1997 | Wadlinger | 101/415.1 |

*Primary Examiner*—Eugene H. Eickholt

*Attorney, Agent, or Firm*—Herbert L. Lerner; Laurence A. Greenberg

[57] ABSTRACT

A gripper device for two-dimensional products on guiding cylinders for the products, the guiding cylinders having respective end faces at which the guiding cylinders are supported in respective side frames, the gripper device including grippers disposed on a driven gripper shaft and cooperatively engageable with gripper pads of a radially movable gripper impact strip, a stop mounted on the driven gripper shaft, the stop being supported on and movable with the gripper impact strip, the products to be accepted being alignable between the gripper fingers, on the one hand, and the gripper impact strip, on the other hand, at the start of a closed stage of the gripper fingers.

17 Claims, 4 Drawing Sheets

Fig. 3
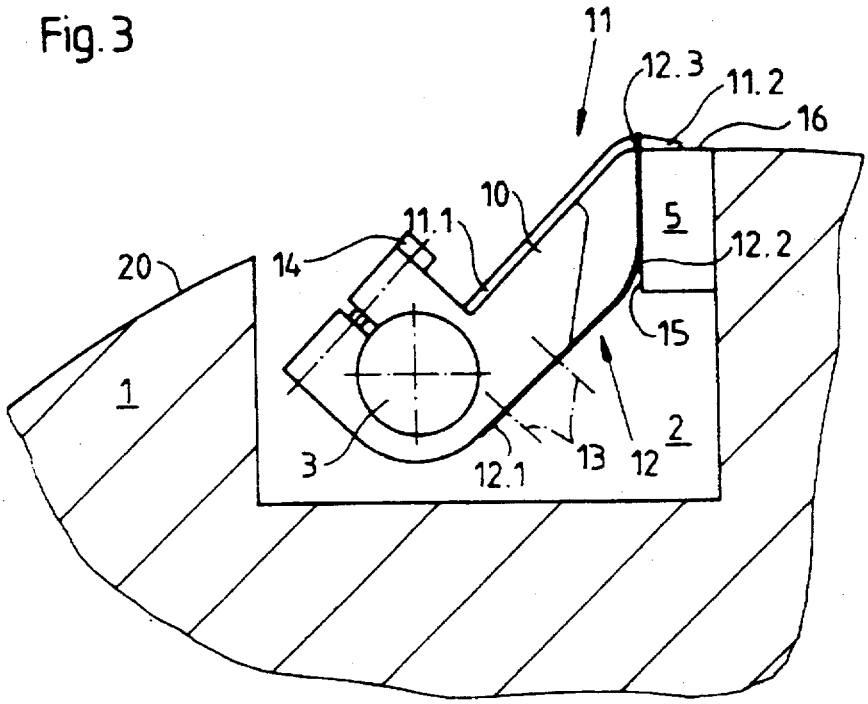
Fig. 5
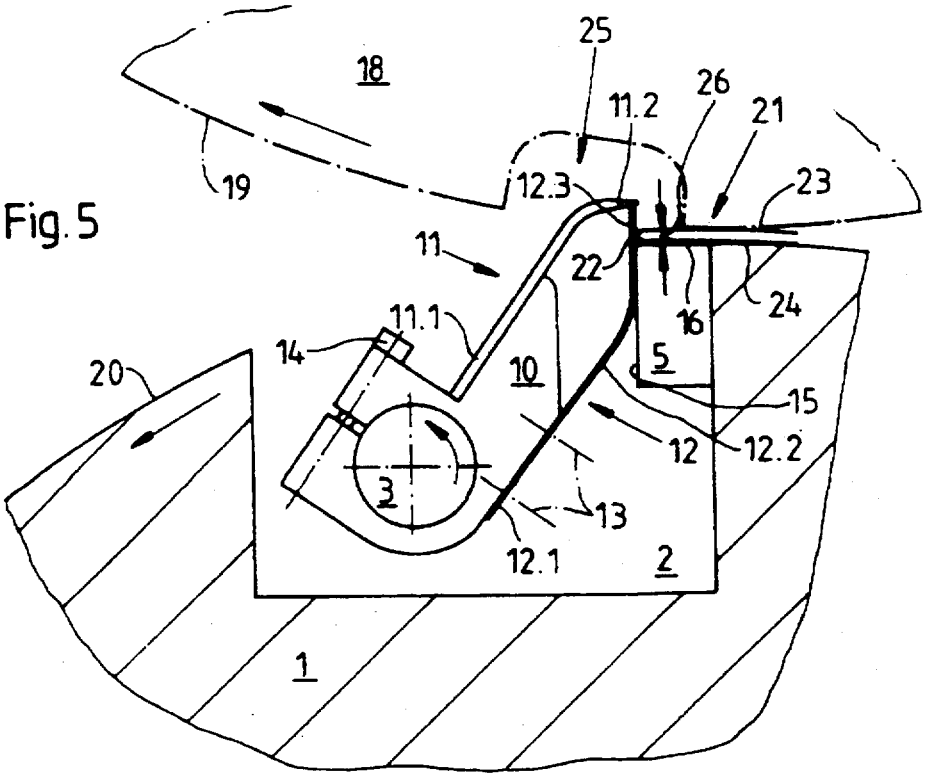
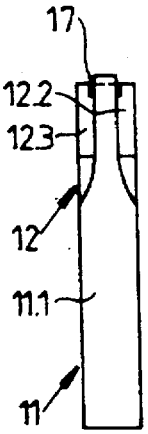
Fig. 4

SLIDABLE STOP ON A PRODUCT-GUIDING CYLINDER ASSOCIATED WITH A ROTARY PRINTING PRESS

BACKGROUND OF THE INVENTION

Field of the Invention

The invention relates to a slidable stop on a product-guiding cylinder associated with a rotary printing press, in particular on a product-guiding cylinder in a folding device located downline from a rotary printing press.

The published German Patent Document DE 35 29 656 A1 discloses a spring-loaded gripper for sheet-fed rotary printing presses. The gripper is formed of a clamping member, which performs a swivelling motion, and a swivellable gripper finger, which is disposed resiliently or springably biased relative thereto, the prebiasing or prestressing of the gripper finger being adjustable. In a second motion phase, the gripper finger should be subject to a form-locking movement approximately perpendicular to the gripper support, with the holding force being reinforced simultaneously. A form-locking connection is one which connects two elements together due to the shape of the elements themselves, as opposed to a force-locking connection, which locks the elements together by force external to the elements. The gripper finger is thereby connected by an articulating joint to a base member loosely supported or carried about the gripper shaft. The gripper finger as well as the base member are adjustably pressable to the clamping member by two pressure springs, which are disposed opposite to one another relative to the gripper shaft, and appertaining stops. The gripper finger has a pivot which can be relocated from the gripper shaft to the articulating joint in a second motion phase by a stop which acts or operates against the cylinder or the drum for providing a force amplifying lever transmission in the vicinity of the periphery of the cylinder or the drum.

The published German Patent Document DE 43 15 844 A1 discloses a sheet gripper on a paper-guiding cylinder of a printing press. The sheet gripper is formed of a leaf spring having a gripper finger provided at one end thereof, a gripper support for the gripper finger and a drive shaft swivellably driven about the longitudinal axis thereof. The leaf spring, by an end thereof located opposite to the gripper finger, is fastened to the cylinder. A holder for an adjustable thrust member is disposed on the drive shaft so as to be fixed against rotation relative thereto, and is active against the leaf spring due to the swivelling motion of the drive shaft in the closing direction of the gripper.

Finally, the published German Patent Document DE 42 33 422 C1 discloses a sheet gripper device for rotary printing presses, preferably for sheet-guiding cylinders of multicolor rotary printing presses. In-register sheet transfer is supposed to be assured by employing a relatively construction, without the occurrence of any slurring. The sheet gripper device described in this published document includes, in addition to a gripper bar provided with grippers, a spring-loaded gripper impact strip, which performs a reciprocating movement due to a linear guide and a roller pair. The gripper impact strip is moved away at the beginning of the gripper closing movement, and is moved back when the grippers reach the closed position thereof.

In order to initiate the reciprocating movement of the gripper impact strip, a roller is disposed on each end face of the gripper impact strip and cooperates with a cam which is fastened in a respective side frame. Furthermore, the gripper impact strip is guided along a linear guide which has a surface provided with bearing balls for reducing abrasion. Considerable expense and effort is required for providing the components used in this heretofore known construction.

Beyond the state of the art outlined hereinabove, gripper impact strips are also known which are always disposed in a stationary manner projecting beyond the outer cylindrical or jacket surface of the respective sheet-guiding cylinder. It is clear that this condition is taken into consideration in that a greater distance must be maintained between the outer cylindrical surface of two product or sheet-guiding cylinders in order to permit a reliable passage of the stationarily mounted gripper impact strip. However, the objective is sought after to keep the distance between two product-guiding cylinders as small as possible in order to achieve a trouble-free transfer of the product from one cylinder to the other cylinder.

SUMMARY OF THE INVENTION

Based upon the foregoing outlined state of the art, it is an object of the invention to provide a slidable stop on a product-guiding cylinder associated with a rotary printing press, including previously existing movable gripper devices for products, wherein the effective stop is optimized upon the arrival of the products on the product-guiding cylinder.

With the foregoing and other objects in view, there is provided, in accordance with the invention, a gripper device for two-dimensional products on guiding cylinders for the products, the guiding cylinders having respective end faces at which the guiding cylinders are supported in respective side frames, the gripper device including grippers disposed on a driven gripper shaft and cooperatively engageable with gripper pads of a radially movable gripper impact strip, a stop mounted on the driven gripper shaft, the stop being supported on and movable with the gripper impact strip, the products to be accepted being alignable between the gripper fingers, on the one hand, and the gripper impact strip, on the other hand, at the start of a closed stage of the gripper fingers.

In accordance with another feature of the invention, the stop is disposed on a gripper body connected to the driven gripper shaft.

In accordance with a further feature of the invention, the stop is of a resilient construction.

In accordance with an added feature of the invention, the stop includes a support region having a resilient construction.

In accordance with an additional feature of the invention, one of the gripper fingers is carried by the gripper body.

In accordance with yet another feature of the invention, the stop and the one gripper finger are disposed in a recess formed in the product-guiding cylinder, the gripper body being movable so as to drive the stop and the one gripper finger simultaneously out of the recess formed in the product-guiding cylinder.

In accordance with yet a further feature of the invention, the stop is formed with a support region, the gripper body being movable so as to move the support region of the stop into engagement with the gripper impact strip.

In accordance with yet an added feature of the invention, the gripper impact strip has an end face formed with a friction-reducing coating.

In accordance with yet an additional feature of the invention, the stop is formed with a recess at an alignment end thereof.

In accordance with still another feature of the invention, the respective gripper finger is received in the respective recess formed in the respective alignment end of the respective stop during a closed stage of the respective gripper finger.

In accordance with still a further feature of the invention, the alignment end forms a stop for the product to be accepted until the closed stage of the gripper finger is terminated.

In accordance with still an added feature of the invention, the stop extends as a continuous stop over the axial length of the recess formed in the product-guiding cylinder.

In accordance with still an additional feature of the invention, the product-guiding cylinder is formed as a sheet-guiding drum.

In accordance with an alternative feature of the invention, the product-guiding cylinder is formed as an output cylinder.

In accordance with another feature of the invention, the product-guiding cylinder has an opposing cylinder adjacent thereto and formed as a folding jaw cylinder.

In accordance with an alternative feature of the invention, the product-guiding cylinder has an opposing cylinder adjacent thereto and formed as a folding knife cylinder.

In accordance with a further alternative feature of the invention, the product-guiding cylinder has an opposing cylinder adjacent thereto and formed as a collecting cylinder.

Because the stops are carried on the gripper bodies which are moved together with the driven gripper shaft, the stops are able to extend or to be driven outwardly whenever a product is to be aligned with that stop. The opposing product-guiding cylinder can be constructed so that the distance or spacing between the cylinders is restricted to the maximum thickness of the product, a fact which also aids in the transport of the product to a considerable extent. However, during the alignment or locating stage of the product, before the gripper fingers clamp the product tightly to the gripper impact strip, a defined alignment or orientation, for example, of the folding spine, is assured. This, in turn, allows for considerably greater accuracy in the further processing of cross-folded products in a second longitudinal folding device located down-line from a cylinder member of a folding device.

In a further construction embodying the inventive concept, the stops which are carried by the gripper bodies are supported resiliently on a stationarily mounted gripper impact strip. It is possible to have a separate stop associated with each gripper body, and also to construct the stop as a profile member extending uninterruptedly, i.e., in one piece, in an axial direction. Furthermore, the alignment or locating ends of the stop or stops can formed, respectively, with a recess into which the gripper finger tip gripping or fixing the product to be accepted dips.

Other features which are considered as characteristic for the invention are set forth in the appended claims.

Although the invention is illustrated and described herein as embodied in a slidable stop on a product-guiding cylinder in a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 3 is a view like those of FIGS. 1 and 2 showing a gripper device according to the invention having a stop which is incorporated with the gripper body and simultaneously movable therewith;

FIG. 4 is a top plan view of an opened gripper device according to the invention, shown before the closed stage thereof;

FIG. 5 is a view similar to that of FIG. 3, showing the gripper device in a different operating stage thereof wherein a product is in engagement with an alignment or locating end of the stop between the outer cylindrical surface of a pair of product-guiding cylinders;

DESCRIPTION OF THE PREFERRED EMBODIMENTS

Figure 1:
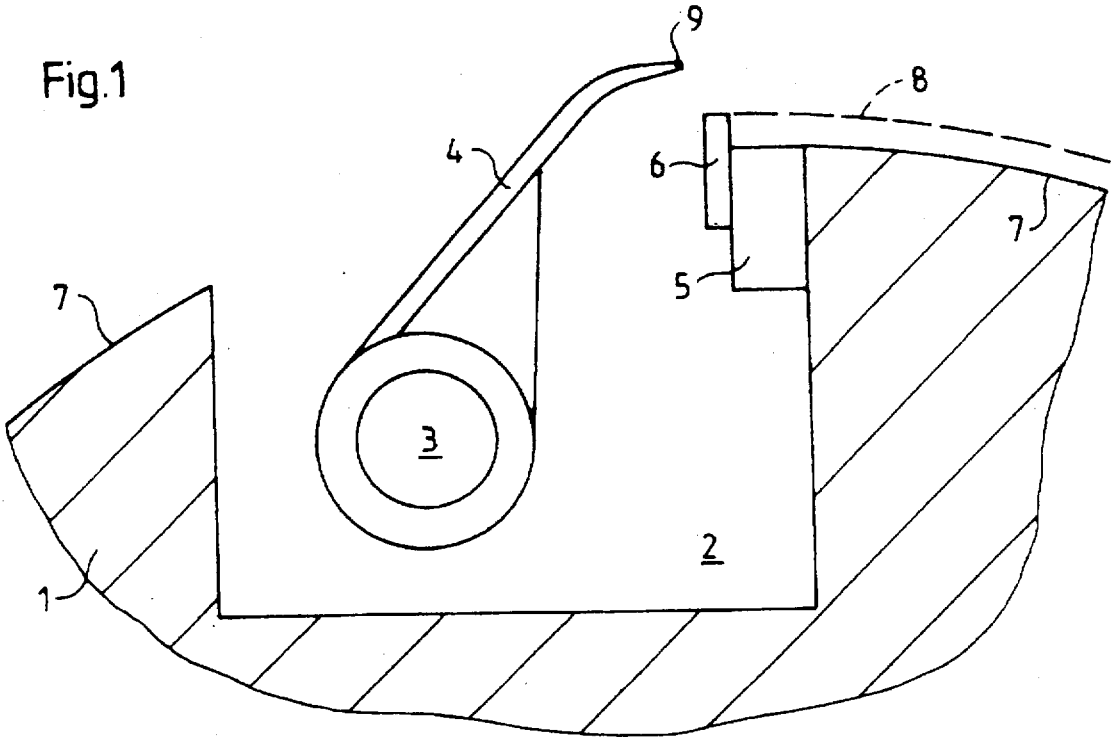
FIG. 1 is a fragmentary diagrammatic sectional view of a product-guiding cylinder having a gripper device according to the prior state of the art, which operates with a stationary stop shown in an open stage thereof.
Figure 2:
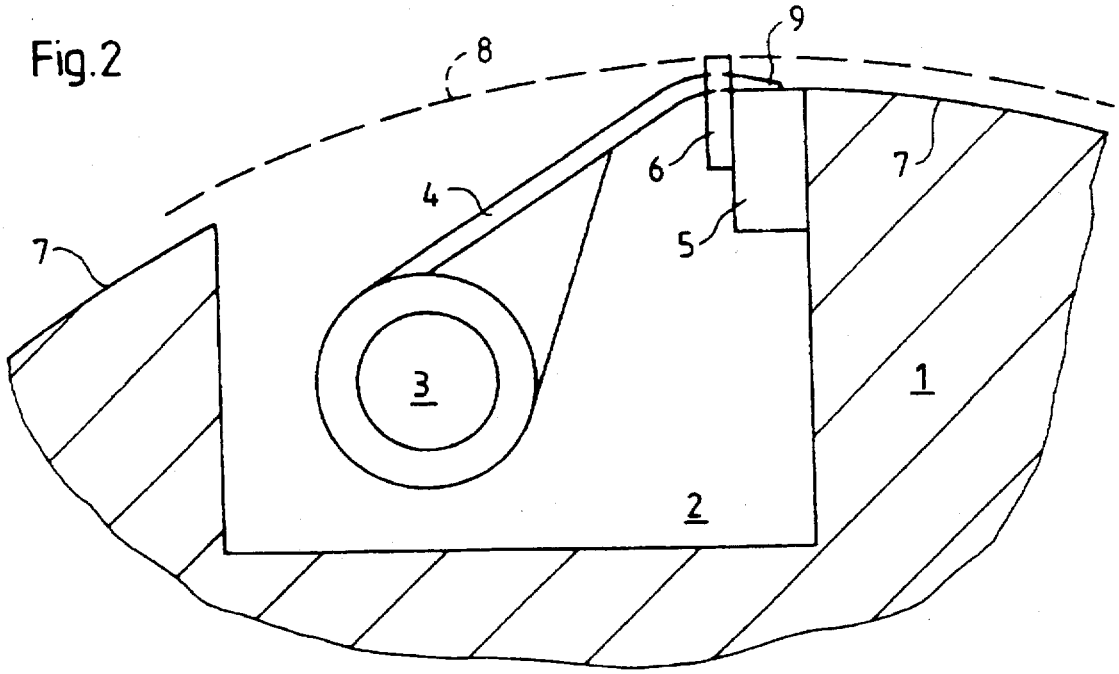
FIG. 2 is a view like that of FIG. 1 showing the gripper device of the prior art operating with a stationary stop in a closed stage thereof, but without the product being gripped thereby.

Referring now to the drawings and, first, particularly to FIGS. 1 and 2 thereof, there is shown diagrammatically therein a gripper device according to the prior art for products having a stationary stop 6 which is fastened to an end face of a gripper impact strip 5. A gripper finger 4 is fastened to a controlled or driven gripper shaft 3, which is fitted within a recess 2 formed in and extending in an axial direction of a product-guiding cylinder 1. An imaginary envelope curve represented by a broken line 8 is accordingly formed between an outer cylindrical surface 7 of the product-guiding cylinder 1 and the outer end of the stationary stop 6. A gripper finger tip 9 formed on the gripper finger 4 dips into recesses formed in the stationary stop 6.

In contrast with the aforedescribed and illustrated gripper device according to the prior art, the gripper device according to the invention is shown in FIGS. 3 to 5.

FIG. 3 shows a gripper device according to the invention having a stop which is incorporated in the gripper body and is simultaneously movable therewith.

A controlled or driven gripper shaft 3 operated by a conventional non-illustrated cam/roller control is supported in the recess 2 formed in the product-guiding cylinder 1. A plurality of gripper bodies 10 are mounted on the gripper shaft and distributed over the axial extension of the product-guiding cylinder 1, the gripper bodies being fastened by a tensioning element 14 to the driven gripper shaft 3. The clamping element 14 can be formed, for example, as a clamping screw, or the like.

A gripper finger 11 is mounted on an upper side of the gripper body 10 and may be formed of metal, plastic material or any other suitable material. The gripper finger 11 is divisible into a gripper-finger neck 11.1 and a gripper-finger tip 11.2. The gripper-finger tip 11.2 is slightly bent or slightly rounded so that, in the closed stage of the gripper finger 11, the gripper-finger tip 11.2 conforms to a top 16 of the gripper impact strip 5 and, thereby, to the outer cylindrical surface 20 of the product-guiding cylinder 1. In this closed stage of the gripper finger 11, the gripper finger tip 11.2 dips into a recess 17 formed in the alignment or locating end 12.3 of the stop 12 (note also FIG. 4). The stop 12 is fastened to a lower side of the gripper body 10 by fastening devices 13 represented in phantom in FIG. 3. The stop 12 can be subdivided into a fastening region 12.1 and a support region 12.2, at an end of which facing the outer cylindrical surface 20 of the product-guiding cylinder 1, the alignment or locating end 12.3 is formed. As shown in FIG. 3, the support region 12.2 engages an end face 15 of the gripper impact strip 5 when the gripper finger 11 is closed, and is supported thereat so that the alignment or locating end 12.3 of the stop 12 is guided outwardly perpendicularly to the outer cylindrical surface 20 of the product-guiding cylinder 1.

FIG. 5 shows the foregoing condition or status. Due to a rotary movement of the controlled or driven gripper shaft 3, initiated by a roller/cam control, for example, the gripper finger 11, as well as the stop 12, are driven out of the recess 2. During this outward driving movement, the support region 12.2 of the stop 12 is supported at the end face 15 of the gripper impact strip 5. The outward driving movement of the gripper finger 11 and the stop 12 occurs simultaneously, because both components are carried by the gripper body 10. The outward driving movement of the gripper finger 11 and the stop 12 occurs cyclically whenever a recess 25 formed in an opposing product-guiding cylinder 18 is located opposite the recess 2 formed in the product-guiding cylinder 1. The alignment or locating end 12.3 and the gripper finger tip 11.2 then dip into the recess 25 so that the rotational movement of the two product-guiding cylinders 1 and 18 is not affected by the outward driving movement of the gripper finger 11 and the stop 12.

The recess 25 formed in the opposing product-guiding cylinder 18 is represented only diagrammatically in FIG. 5. It can, of course, extend farther in the peripheral direction of the opposing product-guiding cylinder 18 than as shown in the figure, so that, during the simultaneous or common rotation thereof, both of the product-guiding cylinders 1 and 18 have available thereto a time interval which is required for a precise alignment of the sheet or product. In addition, the temporary outward drive of the gripper finger 11 and the stop 12 makes it possible to limit a spacing or nip 26 between the outer cylindrical surfaces 19 and 20 of the two product-guiding cylinders 1 and 18, respectively, to the maximum thickness of a product 21 to be processed or to the maximum thickness of the printing material to be processed in the sheet region. The two product-guiding cylinders 1 and 18 can be disposed closer to one another so as to avoid undesired fluttering of the open end of the product 21 to be accepted or so as to prevent the free end of the sheet from lifting up from the outer cylindrical surface 20 of the product-guiding cylinder 1. Because the gripper finger 11 and the stop 12 driving outwardly from the recess 2 of the product-guiding cylinder 1 dip into a respective opposing recess 25, it is possible to create envelope curves 8 which, in comparison with the embodiments according to the state of the prior art, as illustrated in FIGS. 1 and 2, are not determined by the stop 6 fastened stationarily to the gripper impact strip 5, but rather by the thickness of the product 21 to be accepted or the printing material to be processed.

In the outwardly driven or extended condition of the gripper finger 11 and the stop 12, wherein the latter components dip into the recess 25 formed in the opposing product-guiding cylinder 18, the alignment or locating end 12.3 forms a locating or alignment surface for a folding spine 22 of the product 21 to be accepted. Of course, this may also be the leading edge of a printed or unprinted sheet to be accepted. The product 21 to be accepted which, in this case is an upper side 23 and a lower side 24, for example, of the product, is surrendered to the product-guiding cylinder 1. At the stage shown in FIG. 5, the folding spine 22 lies on the alignment or locating end 12.3. During the closing movement of the controlled or driven gripper shaft 3 and, thereby, of the gripper body 10, opposite to the direction of the curved arrow shown on gripper shaft 3 in FIG. 5, the gripper finger tip 11.2 moves down to the upper side 23 of the product 21 to be accepted, the folding spine 22 of which lies continually adjacent to the alignment or locating end 12.3 of the stop 12.

At the instant of time that the product 21 to be accepted is gripped by the gripper finger tip 11.2, the product 21 is aligned and is fixed in the aligned position thereof between the gripper finger tip 11.2 and the top 16 of the gripper impact strip 5. The product 21 to be accepted cannot slide into an undefined position.

Because, on the one hand, the product 21 to be accepted does not shift on the outer cylindrical surface 20 of the product-guiding cylinder 1 during the gripping operation and, on the other hand, a smaller spacing between the outer cylindrical surfaces 19 and 20 of the product-guiding cylinders 1 and 18 is possible by the application of the principles according to the invention, the transfer of the folded product 21 or the sheet between the two adjacent product-guiding cylinders 1 and 18 can be effected with considerably greater precision on the whole than heretofore.

Figure 6:
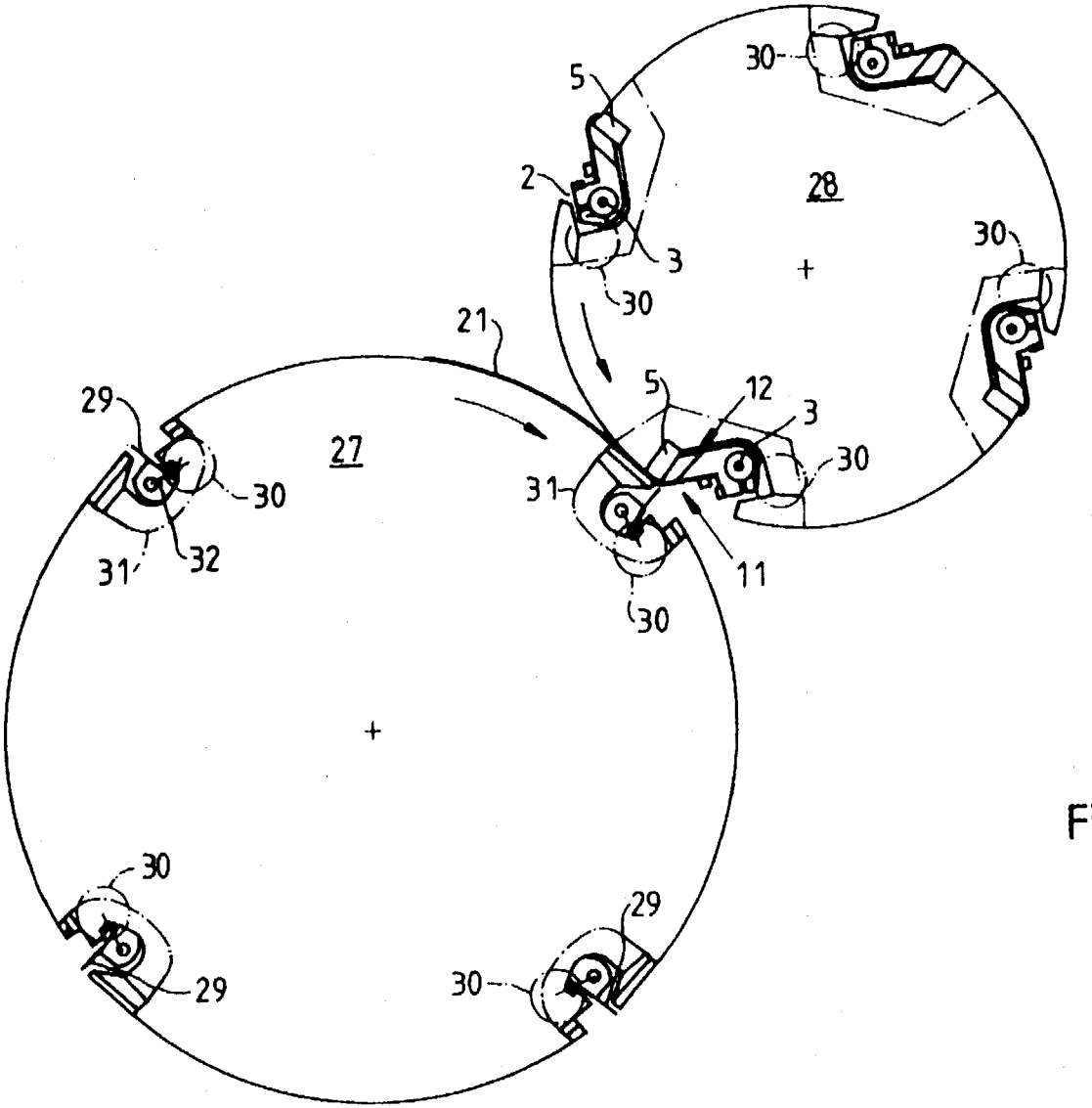
FIG. 6 is a diagrammatic end view of a folding cylinder and a delivery cylinder illustrating the transfer of a product from the former to the latter.

FIG. 6 shows, for example, two such adjacent sheet-guiding cylinders as folding cylinders and output cylinders, respectively.

The copies or sheets 21 to be accepted are transferred, as shown in FIG. 6, for example, from a folding cylinder 27 to an output cylinder 28; the folding cylinder 27 can be equipped with either folding knives or folding jaws 29 or with both, which release the copies 21 to the opposing output cylinder 28, so that they can be accepted by the opposing output cylinder 28 in alignment at the stops 12 which can be outwardly driven or extended together with the gripper fingers 11. Movable folding jaws 29 can be opened or closed by a conventional, diagrammatically illustrated roller lever control 30, 32.

Figure 7:
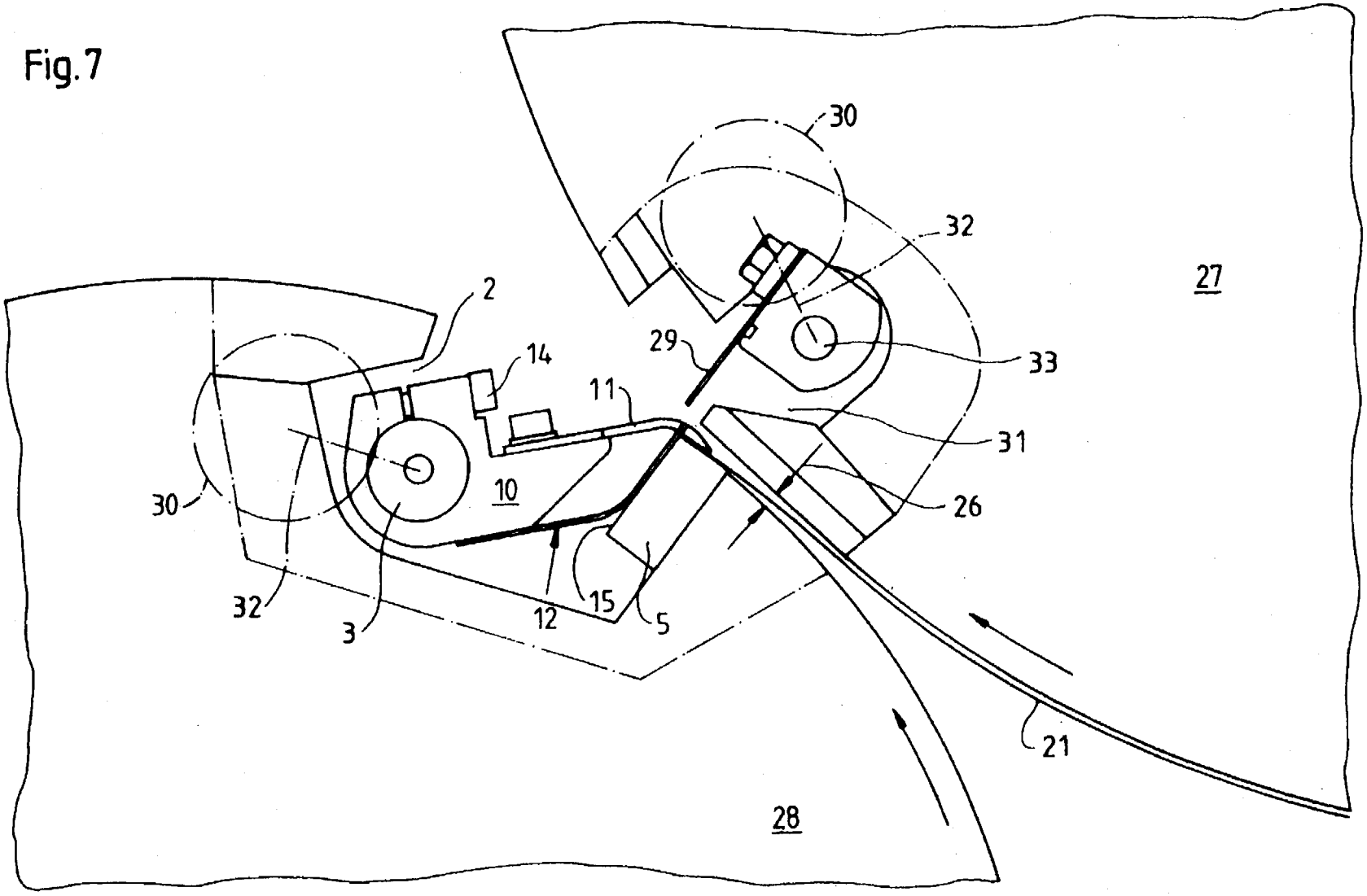
FIG. 7 is an enlarged fragmentary view of FIG. 6 showing the product transfer region between the delivery cylinder and a folding cylinder.

FIG. 7 is a much-enlarged representation of the transfer region between the output cylinder 28 and the folding cylinder 29.

In the operating phase or stage represented in FIG. 7, the tip of gripper finger 11 has accepted or received the product 21 transported by the cylinder 27, irrespective of whether the latter is a folding knife or tucker blade cylinder, a folding jaw cylinder for a double parallel or a delta fold, a collecting cylinder or a transfer cylinder for sheets or the like. After the opening and alignment phase, respectively, described in conjunction with FIGS. 3, 4 and 5, gripper finger 11 has gripped the product 21 to be accepted. The correctly aligned product 21 and the precisely aligned sheet, respectively, can then be gripped and fastened or fixed by the gripper finger 11 so as to pass through the spacing or nip 26 between the respective outer cylindrical surfaces of the cylinders 27 and 28. The spacing or nip 26 is determined by the thickness of the material of the tip of gripper finger 11 and not by stationary and rigidly assembled alignment stops, which would require a greater spacing or nip between the outer cylindrical surfaces of the cylinders 1 and 18, on the one hand, and the cylinders 27 and 28, on the other hand.

It should be noted that the transfer of a product between cylinders in a folding device, which was described hereinbefore, can be just as easily applied to sheet-processing machines and the sheet transfer occurring therein.

We claim:

1. A gripper device for two-dimensional products on guiding cylinders for the products, the guiding cylinders having respective end faces at which the guiding cylinders are supported in respective side frames, the gripper device including gripper fingers disposed on a driven gripper shaft and cooperatively engageable with gripper pads of a radially movable gripper impact strip, comprising a stop mounted on the driven gripper shaft, said stop being supported on and movable with the gripper impact strip, the products to be accepted being alignable between the gripper fingers, on the one hand, and the gripper impact strip, on the other hand, at the start of a closed stage of the gripper fingers.

2. The gripper device according to claim 1, wherein said stop is disposed on a gripper body connected to the driven gripper shaft.

3. The gripper device according to claim 1, wherein said stop is of a resilient construction.

4. The gripper device according to claim 3, wherein said stop includes a support region having a resilient construction.

5. The gripper device according to claim 2, wherein one of said gripper fingers is carried by said gripper body.

6. The gripper device according to claim 5, wherein said stop and said one gripper finger are disposed in a recess formed in the product-guiding cylinder, said gripper body being movable so as to drive said stop and said one gripper finger simultaneously out of said recess formed in the product-guiding cylinder.

7. The gripper device according to claim 6, wherein said stop is formed with a support region, said gripper body being movable so as to move said support region of said stop into engagement with the gripper impact strip.

8. The gripper device according to claim 1, wherein the gripper impact strip has an end face formed with a friction-reducing coating.

9. The gripper device according to claim 1, wherein said stop is formed with a recess at an alignment end thereof.

10. The gripper device according to claim 9, wherein the respective gripper finger is received in the respective recess formed in the respective alignment end of the respective stop during a closed stage of the respective gripper finger.

11. The gripper device according to claim 10, wherein said alignment end forms a stop for the product to be accepted until the closed stage of the gripper finger is terminated.

12. The gripper device according to claim 6, wherein said stop extends as a continuous stop over the axial length of said recess formed in the product-guiding cylinder.

13. The gripper device according to claim 1, wherein the product-guiding cylinder is formed as a sheet-guiding drum.

14. The gripper device according to claim 1, wherein the product-guiding cylinder is formed as an output cylinder.

15. The gripper device according to claim 1, wherein the product-guiding cylinder has an opposing cylinder adjacent thereto and formed as a folding jaw cylinder.

16. The gripper device according to claim 1, wherein the product-guiding cylinder has an opposing cylinder adjacent thereto and formed as a folding knife cylinder.

17. The gripper device according to claim 1 wherein the product-guiding cylinder has an opposing cylinder adjacent thereto and formed as a collecting cylinder.

* * * * *